US010433624B2

(12) United States Patent
Amago

(10) Patent No.: US 10,433,624 B2
(45) Date of Patent: Oct. 8, 2019

(54) DUFFEL BAG

(71) Applicant: NIKE, Inc., Beaverton, OR (US)

(72) Inventor: Justin Amago, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 547 days.

(21) Appl. No.: 14/669,905

(22) Filed: Mar. 26, 2015

(65) Prior Publication Data

US 2016/0278491 A1 Sep. 29, 2016

(51) Int. Cl.

| | |
|---|---|
| ***A45F 3/04*** | (2006.01) |
| ***A45C 3/00*** | (2006.01) |
| ***A45C 13/10*** | (2006.01) |
| ***A45C 5/06*** | (2006.01) |

(52) U.S. Cl.

CPC ..... *A45C 3/00* (2013.01); *A45C 5/06* (2013.01); *A45C 13/103* (2013.01); *A45C 2013/1015* (2013.01)

(58) Field of Classification Search

CPC .. A45C 3/00; A45C 13/02; A45C 5/00; A45C 3/004; A45C 3/02

USPC ..... 190/111, 112, 109; 206/579, 315.1, 206/315.9; D3/36, 48, 256, 217

See application file for complete search history.

(56) References Cited

U.S. PATENT DOCUMENTS 655,583 A * 8/1900 Scholz ..... A45C 7/00
1,711,349 A * 4/1929 Howard ..... A45C 3/00 190/111
2,432,365 A * 12/1947 Mannie ..... A45C 13/002 150/154
D262,072 S * 12/1981 Pfeiffer ..... D3/256
4,805,748 A * 2/1989 Gerch ..... A45C 3/00 150/163
5,431,265 A * 7/1995 Yoo ..... A45C 3/00 190/103

(Continued)

FOREIGN PATENT DOCUMENTS

DE 7901467 U1 5/1979
JP H0739413 A 2/1995

OTHER PUBLICATIONS

International Search Report and Written Opinion dated Aug. 18, 2016 for International Patent Application No. PCT/US2016/023438, 16 pages.

*Primary Examiner* — Fenn C Mathew
*Assistant Examiner* — Cynthia F Collado
(74) *Attorney, Agent, or Firm* — Shook, Hardy & Bacon L.L.P.

(57) ABSTRACT

A duffel bag includes a main compartment having a set of walls and an accessory storage compartment coupled to an outward-facing surface of at least one wall of the set of walls. The accessory storage compartment has one or more walls that define an accessory storage space between the outward-facing surface and the one or more walls of the accessory storage compartment. The accessory storage compartment includes an opening that provides access to the accessory storage space. At least one closure mechanism divides the opening into a first slot and a second slot by releasably bridging the opening. A carrying handle is provided, the carrying handle configured to cover or overlay the at least one closure mechanism in a stacked configuration when the carrying handle is in the carrying configuration.

20 Claims, 6 Drawing Sheets

(56) References Cited

U.S. PATENT DOCUMENTS

| | | | | |
|---|---|---|---|---|
| 6,555,583 | B2 * | 4/2003 | Nieman | A61K 31/19<br>514/572 |
| 7,040,486 | B2 * | 5/2006 | Godshaw | A45C 5/005<br>132/312 |
| 7,395,930 | B2 * | 7/2008 | Tauchen | A45C 3/00<br>190/109 |
| 9,642,443 | B2 * | 5/2017 | Amago | A45F 3/04 |
| 2005/0115848 | A1 | 6/2005 | Tauchen | |
| 2016/0278506 | A1 * | 9/2016 | Amago | A45F 3/04 |

* cited by examiner

DUFFEL BAG

TECHNICAL FIELD

The field of the invention relates to a bag, such as a duffel bag.

BRIEF SUMMARY

In brief, at a high level, this disclosure describes, among other things, a duffel bag having a main compartment and at least one accessory storage compartment, the accessory compartment having a closure mechanism that divides the opening into a first slot and a second slot by releasably bridging the opening.

In a first aspect, a duffel bag comprises a main compartment having a set of walls enclosing a main storage space. The duffel bag also includes an accessory storage compartment coupled to an outside surface of at least one wall of the set of walls, the accessory storage compartment having one or more walls that define an accessory storage space between the outside surface and the one or more walls of the accessory storage compartment. The accessory storage compartment includes an opening that provides access to the accessory storage space. The duffel bag further has a closure mechanism that divides the opening into a first slot and a second slot by releasably bridging the opening. A carrying handle is also coupled to the duffel bag.

In a second aspect, an accessory storage compartment is coupled to an outward-facing surface of a wall of the set of walls. The accessory storage compartment includes an exterior wall that at least partially defines an accessory storage space between the exterior wall and the outward-facing surface. The exterior wall includes an interior surface, which faces towards the outward-facing surface and the accessory storage space, and an exterior surface generally opposing the interior surface and facing away from the accessory storage space. The accessory storage compartment includes an opening that provides access to the accessory storage space and a lockdown strap having a proximal end attached to the duffel bag and a distal end releasably attachable to the exterior surface of the exterior wall. The lockdown strap divides the opening into a first slot and a second slot when the distal end is attached to the exterior surface and is releasably bridging the opening. The bag also includes a carrying handle attached to the exterior surface at an attachment point, the carrying handle also including a detached elongated portion extending from the attachment point. The detached elongated portion is configurable into a carrying arrangement in which the detached elongated portion at least partially obscures the distal end of the lockdown strap when the distal end is attached to the exterior surface.

In a third aspect, the main compartment has a top end and a bottom end, a first side and a second side, and a front side and a back side, and the main-compartment top end includes a first opening that provides access to the main storage space. The duffel bag further has an accessory storage compartment coupled to an outside surface of the main compartment and oriented towards a side of the main compartment, the accessory storage compartment having a set of walls that define an accessory storage space. The accessory storage compartment includes a top end and a bottom end, a first side and a second side, and a front side and a back side, and the accessory storage compartment includes a second opening that provides access to the accessory storage space. The duffel bag further includes a closure mechanism coupled near the top end of the second compartment and configured to releasably bridge the second opening to divide the second opening into a first slot and a second slot. A divider is positioned in the accessory storage space and extends between the front side and the back side of the accessory storage compartment. The divider separates at least a portion of the accessory storage space into a first interior section and a second interior section. The first slot and the first interior section are alignable to form a first equipment-storage compartment, and the second slot and the second interior section are alignable to form a second equipment-storage compartment. A carrying handle is also coupled to the duffel bag.

This summary is intended to provide a high-level overview of various aspects of the invention and to introduce a selection of concepts that are further described below in the detailed description section. This summary is not intended to identify key or essential features of the claimed subject matter, nor is it intended to be used as an aid in isolation to determine the scope of the claimed subject matter. The scope of the invention is defined by the claims.

BRIEF DESCRIPTION OF THE DRAWINGS

The claimed subject matter is described in detail herein with reference to the attached drawing figures, which are incorporated herein by reference. In reference to the figures:

DESCRIPTION OF THE DRAWINGS

Various aspects of claimed subject matter are described with specificity herein to meet statutory requirements. The description itself is not intended to limit the scope of the claims. Rather, the claimed subject matter might be embodied or carried out in other ways to include different elements, combinations, components, and/or steps, including those similar to the ones described in this document, and in conjunction with other present and/or future technologies.

This description generally describes a duffel bag having a main compartment and an accessory storage compartment. The main compartment has a set of walls enclosing a main storage space. The accessory storage compartment is coupled to an outward-facing surface of at least one wall of the set of walls, and the accessory storage compartment has one or more walls at least partially defining the accessory storage space between the outward-facing surface. The accessory storage compartment also includes an opening that provides access to the accessory storage space, and the duffel bag may include one or more closure mechanisms for securing the opening and dividing the opening into multiple slots. The duffel bag might also include a carrying handle.

The duffel bag may include a first closure mechanism configured to releasably bridge the accessory-compartment opening and divide the opening into a first slot and a second slot. In addition, a second closure mechanism might releasably secure together first and second edges of the accessory-compartment opening. The carrying handle and the first closure mechanism may be aligned in a stacked, or overlaying, configuration when the carrying handle is in a carrying configuration and the first closure mechanism is secured to the duffel bag. In other arrangements, the second closure mechanism might also be stacked with the handle and/or the firs closure mechanism. In addition, a divider may be positioned in the accessory storage compartment, the divider at least partially dividing the accessory storage compartment into a first interior section and a second interior section. In this regard, a first slot and the first interior section may be alignable to form a first equipment-storage compartment, and a second slot and the second interior section may be alignable to form a second equipment-storage compartment.

Figure 1:
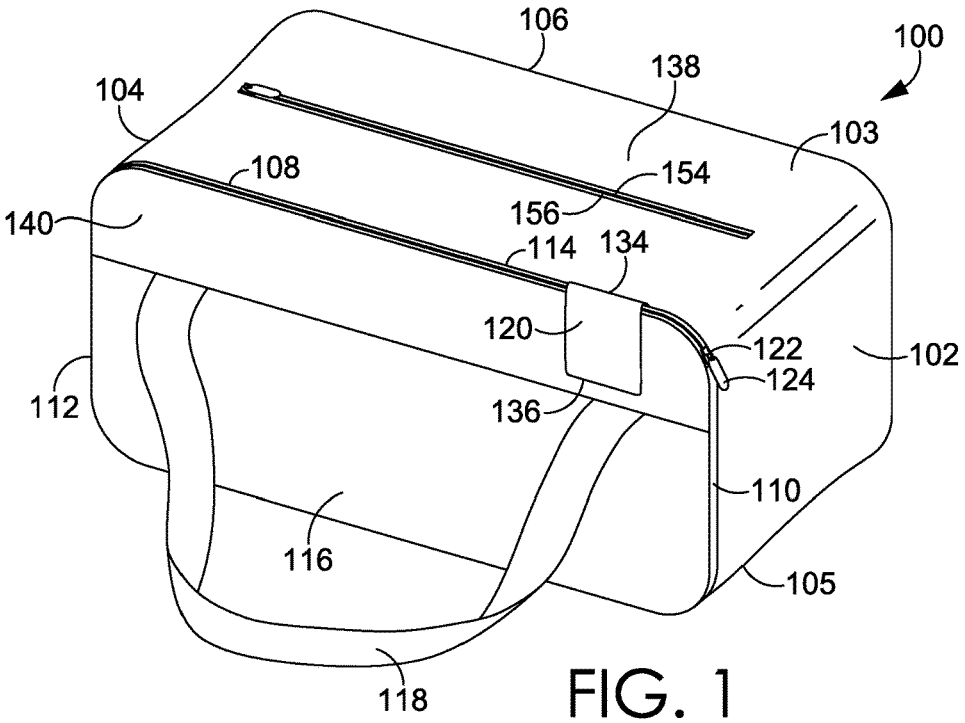
FIG. 1 depicts a side perspective view of a duffel bag having an accessory storage compartment with multiple closure mechanisms in a first partially secured configuration, in accordance with an aspect of the present invention.
Figure 2A:
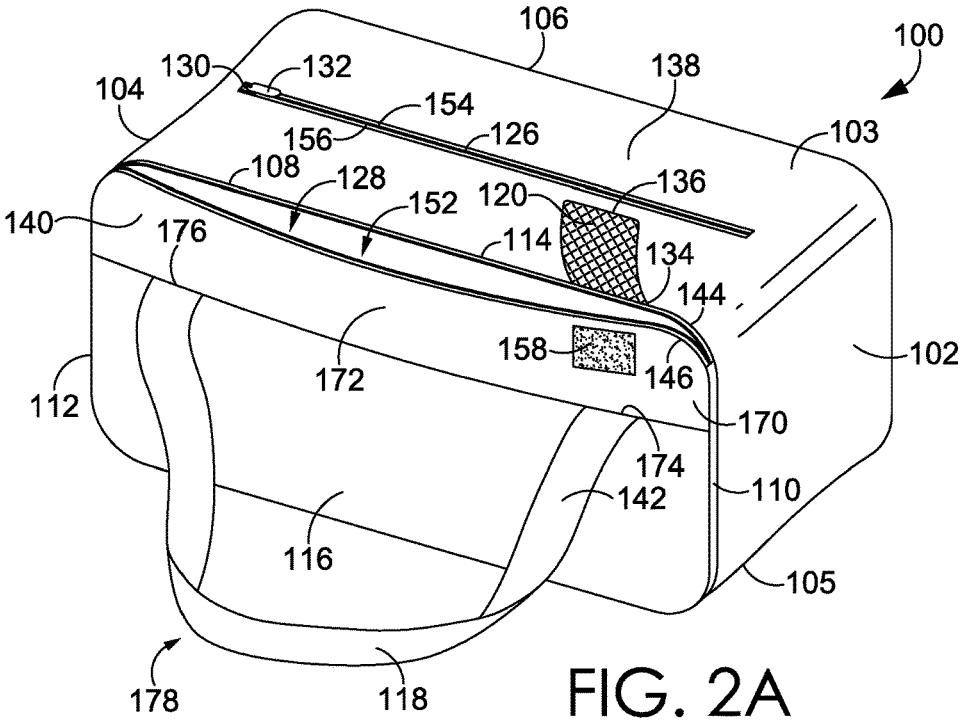
FIG. 2A depicts the duffel bag of FIG. 1 in a second partially secured configuration, in accordance with an aspect of the present invention.
Figure 2B:
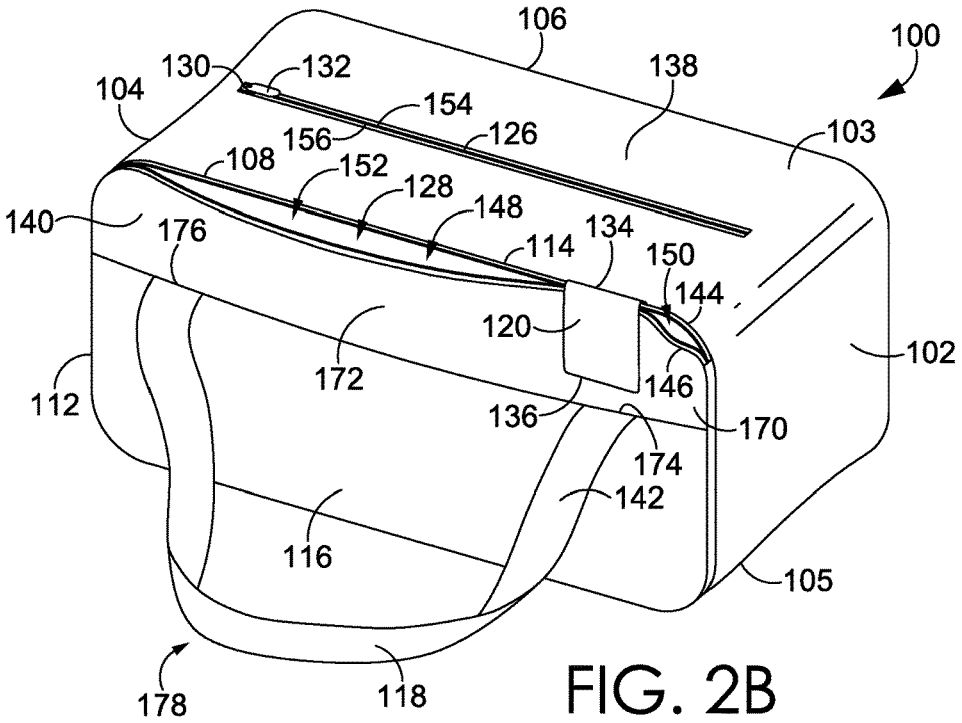
FIG. 2B depicts the duffel bag of FIG. 1 in a third partially secured configuration, in accordance with an aspect of the present invention.
Figure 2C:
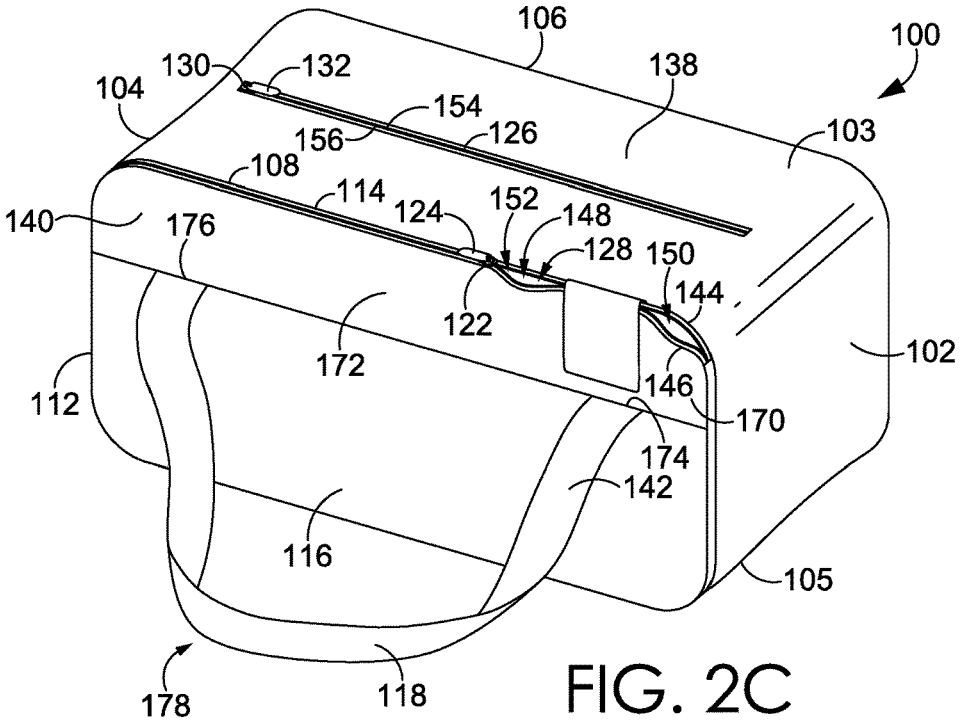
FIG. 2C depicts the duffel bag of FIG. 1 in a fourth partially secured configuration, in accordance with an aspect of the present invention.
Figure 2D:
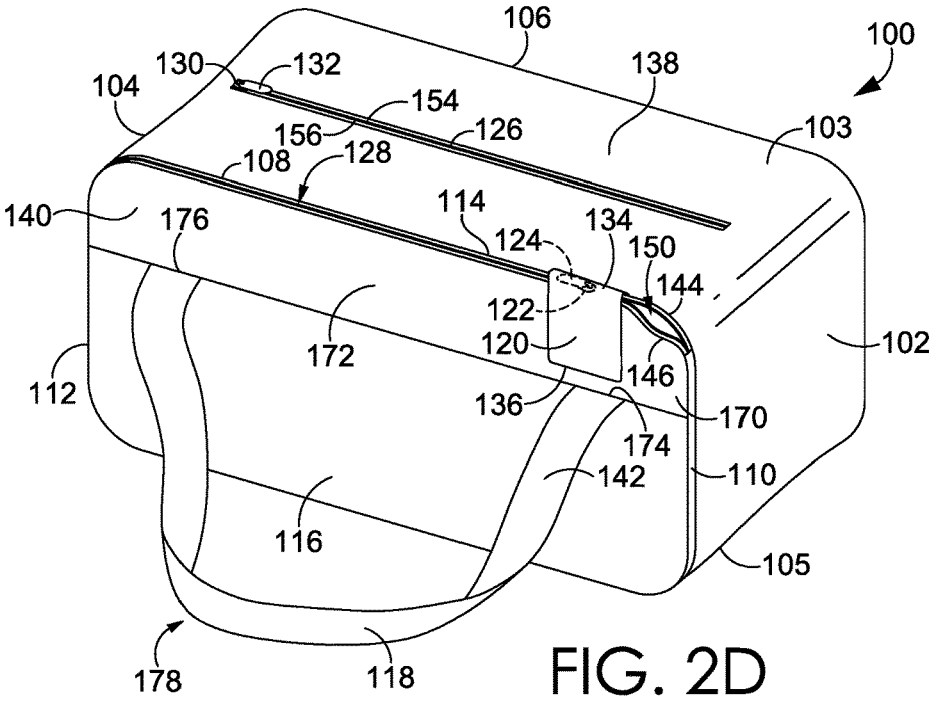
FIG. 2D depicts the duffel bag of FIG. 1 in a fifth partially secured configuration, in accordance with an aspect of the present invention.
Figure 2E:
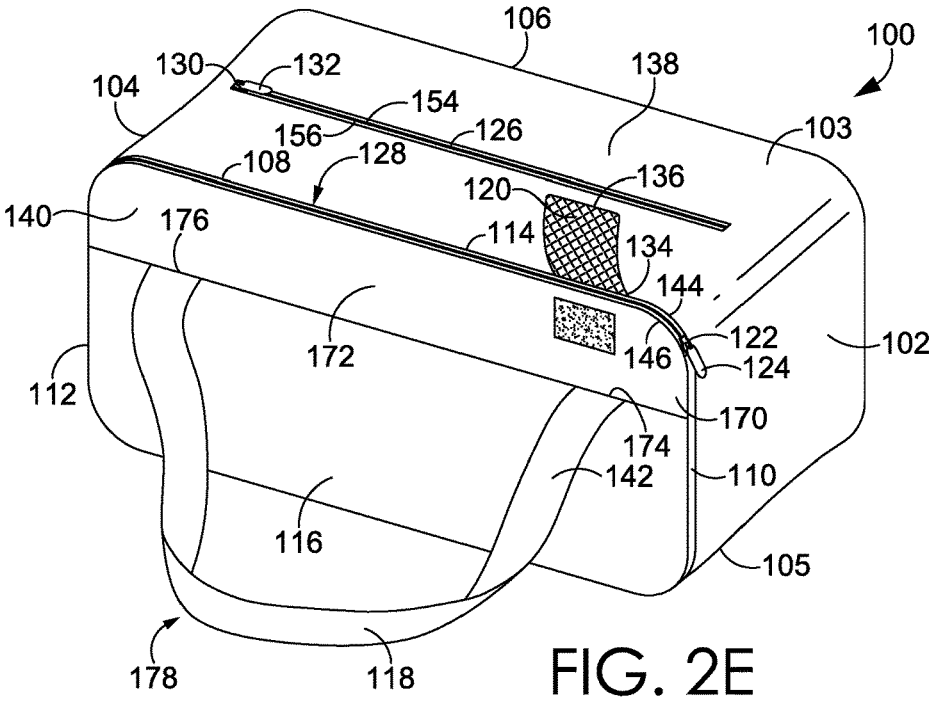
FIG. 2E depicts the duffel bag of FIG. 1 in a sixth partially secured configuration, in accordance with an aspect of the present invention.
Figure 2F:
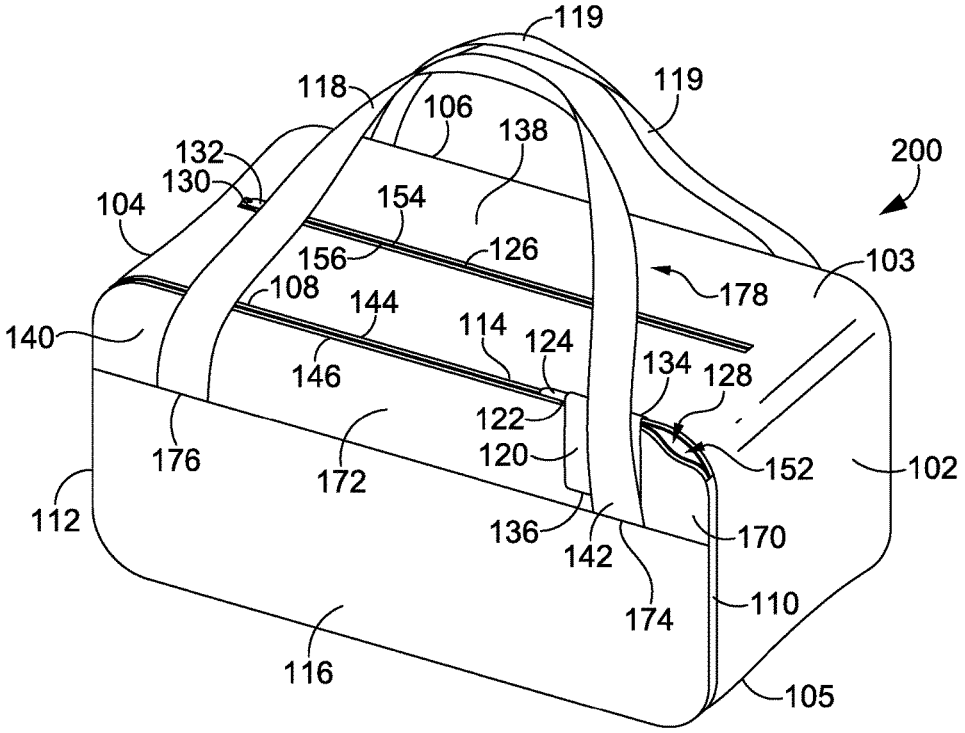
FIG. 2F depicts a duffel bag with first and second handles in a carrying configuration, the first handle overlaying the closure mechanisms, in accordance with an aspect of the present invention.

Having generally described some features of a duffel bag in accordance with aspects of the present invention, reference is now made to FIGS. 1-2F to describe some elements of an exemplary duffel bag 100. In FIGS. 1-2F, the bag 100 includes mostly the same components, which include a first closure mechanism 120 and a second closure mechanism 122. But the different views provided by FIGS. 1-2F are provided to shown the closure mechanisms in different configurations. For example, in FIG. 1 both closure mechanisms 120 and 122 are in a closed state, and in FIG. 2A the closure mechanisms are in an open state. By showing the closure mechanisms 120 and 122 in different states, various aspects of the bag 100 can be explained and exemplified.

In FIG. 1, the duffel bag 100 is depicted in a first secured configuration in which both the first closure mechanism 120 and the second closure mechanism 122 are in a closed state, in accordance with an aspect of the present invention. Generally, the duffel bag 100 includes a main compartment 138 defined by a set of walls and an accessory storage compartment 140 defined by a set of walls. The main compartment 138 includes a front 102, a back 104, a left side 106, a right side 108, a top end 103, and a bottom end 105. The accessory storage compartment 140 is positioned near the right side 108 of the main compartment and also includes a front 110, a back 112, a left side 114, and a right side 116. The main compartment right side 108 and the accessory compartment left side 114 are coupled, proximate, and/or contiguous with each other, and may even be the same wall or panel. A carrying strap 118 is shown coupled to the duffel bag 100.

Referring to FIG. 2A, the duffel bag 100 is depicted in a second partially secured configured in which both the first closure mechanism 120 and the second closure mechanism 122 are in an unsecured state, in accordance with an aspect of the present invention. In FIG. 2A, the first closure mechanism 120 is a flap-type closure mechanism, which may alternatively be referred to as a lockdown strap, for releasably securing and/or bridging an opening 128 of the accessory storage compartment 140. Lockdown strap is one exemplary description of the first closure mechanism, and different straps, flaps, connectors, extended securement mechanisms, or other bridging components may be used. These components may include varying shapes, lengths, or sizes, and may include different attachment components (e.g., velcro, buttons, snaps, male-female connectors, etc.). In FIG. 2A, the first closure mechanism 120 includes a first end 134 affixed or secured to the duffel bag 100 near the top end 103 of the main compartment 138, and a second distal end 136 releasably securable, or attachable, to the duffel bag 100. The first closure mechanism 120 (i.e., lockdown strap), may be positioned anywhere along the opening 128 of the accessory storage compartment 140, to provide slots 148, 150 (e.g., FIG. 2B) that might be different sizes.

The first end 134 of the first closure mechanism 120 may be sewn, stitched, or bonded to the duffel bag 100, and the second free-floating or distal end 136 may be releasably secured to the outward facing surface 172 of the exterior wall 170 of the accessory compartment 140 at a mating component 158. This securement can be accomplished using Velcro, hook-and-loop fasteners, a male-female connector system, buttons, straps, and/or other similar components. In FIG. 2A, the accessory storage compartment 140 is oriented towards a side of the main compartment 138, in this case the right side 108. The accessory storage space 152 inside the accessory compartment 140 is defined by a space between the left wall 114 of the accessory compartment 140 and the right wall 116 of the accessory compartment 140. In this regard, the left wall 114 of the accessory compartment 140 and the right wall 108 of the main compartment 138 are coupled, integrated, contiguous, or the same. The main compartment 138 further includes a main compartment opening 126 (depicted closed in FIG. 2A) located near the top end 103 of the main compartment 138, the opening 126 secured by a main compartment closure mechanism 130 having a zipper pull 132 that releasably secures a first top edge 154 of the main opening 126 to a second top edge 156 of the main opening 126.

In FIG. 2A, the carrying handle/strap 118 is shown in a resting position, not covering any portion of the first closure mechanism 120, the second closure mechanism 122, or the accessory storage compartment opening 128. The carrying strap 118 is attached to the exterior surface 170 of the accessory storage compartment 140 at a first attachment point 174 and a second attachment point 176, with an elongated portion 178 extending between the attachment points 174, 176 and detached from the exterior surface 170. In an exemplary aspect, a portion 142 of the carrying strap 118 is alignable with the first and the second closure mechanisms 120, 122 of the accessory storage compartment 140 to provide various functions, such as at least partial concealment and additional security.

In reference to FIG. 2B, the duffel bag 100 of FIG. 1 is shown in a third partially secured configuration, in accordance with an aspect of the present invention. In FIG. 2B, the first closure mechanism 120 is secured, dividing the opening 128 of the accessory storage compartment 140 into a first slot 148 and a second slot 150, which individually provide access to the storage space 152 of the accessory storage compartment 140. The first closure mechanism 120 therefore releasably bridges the opening 128. The second closure mechanism 122 is unsecured, with the first and second edges 144, 146 separated and at least partially defining the opening 128.

In reference to FIG. 2C, the duffel bag 100 of FIG. 1 is shown in a fourth partially secured configuration, in accordance with an aspect of the present invention. In FIG. 2C, the duffel bag 100 is shown with the first closure mechanism 120 releasably secured and forming the first and second slots 148, 150, and the second closure mechanism 122 including a zipper pull 124 is shown partially secured, the zipper pull 124 pulled across a portion of the opening 128 and joining a portion of the first and second edges 144, 146 of the opening 128. As a result, two slots 148, 150 are formed from the opening 128 of the accessory storage compartment 140. The slots are depicted in FIG. 2C as having an illustrated size, but the respective sizes might vary based on an overall size of the opening 128 and a position of the first closure mechanism 120. As described herein, equipment stored in the storage space 152 may be secured with the slots 148, 150, or might extend from the storage space 152 through the slots 148, 150.

In reference to FIG. 2D, the duffel bag 100 of FIG. 1 is shown in a fifth partially secured configuration, in accordance with an aspect of the present invention. In FIG. 2D, the first closure mechanism 120 is releasably secured to the outward-facing surface 172 of the exterior wall 170. The zipper pull 124 of the second closure mechanism 122 is pulled to a position proximate to the first closure mechanism 120. Only a single slot, the second slot 150, is open when the zipper pull 124 is positioned in the arrangement shown in FIG. 2D, adjacent to the first closure mechanism 120, or rather, in a stacked arrangement.

In reference to FIG. 2E, the duffel bag 100 of FIG. 1 is shown in a sixth partially secured configuration, in accordance with an aspect of the present invention. In FIG. 2E, the first closure mechanism 120 is unsecured, with the second distal end 136 free-floating, and the second closure mechanism 124 is fully secured, with the zipper pull 124 pulled all the way towards the front 110 of the accessory compartment 140 to close the opening 128. In the example shown in FIG. 2E, there is limited access to the storage space 152.

In reference to FIG. 2F, a duffel bag 200 with first and second handles in a carrying configuration is shown, in accordance with an aspect of the present invention. In FIG. 2F, the duffel bag 200 is shown with the elements described in FIGS. 1-2E. In addition to the first carrying handle 118, a second carrying handle 119 is coupled to the duffel bag 200 on the opposite side of the main compartment 138 as the first carrying handle 118. In FIG. 2F, the first carrying handle 118 is positioned on the right side 116 of the accessory storage compartment 140, coupled to the exterior wall 170, and the matching carrying handle 119 is positioned on the left side 106 of the main compartment 138. When the first carrying handle 118 is configured in a carrying configuration, at least a portion of the carrying handle, such as the portion 142, aligns with the first and/or the second closure mechanism 120, 122 to form a stacked, or layered arrangement, the handle portion 142 and the first closure mechanism 120 coupled, or in contact. In other words, in the carrying configuration, a portion 142 of the carrying strap 118 covers at least a portion of the first closure mechanism 120 and the second closure mechanism 122, providing enhanced securement of the opening 128. In FIG. 2F, the zipper pull 124 is also aligned with the first closure mechanism 120 and positioned at least partially under the first closure mechanism 120 and the handle portion 142 such that it is part of the stacked arrangement.

Figure 3:
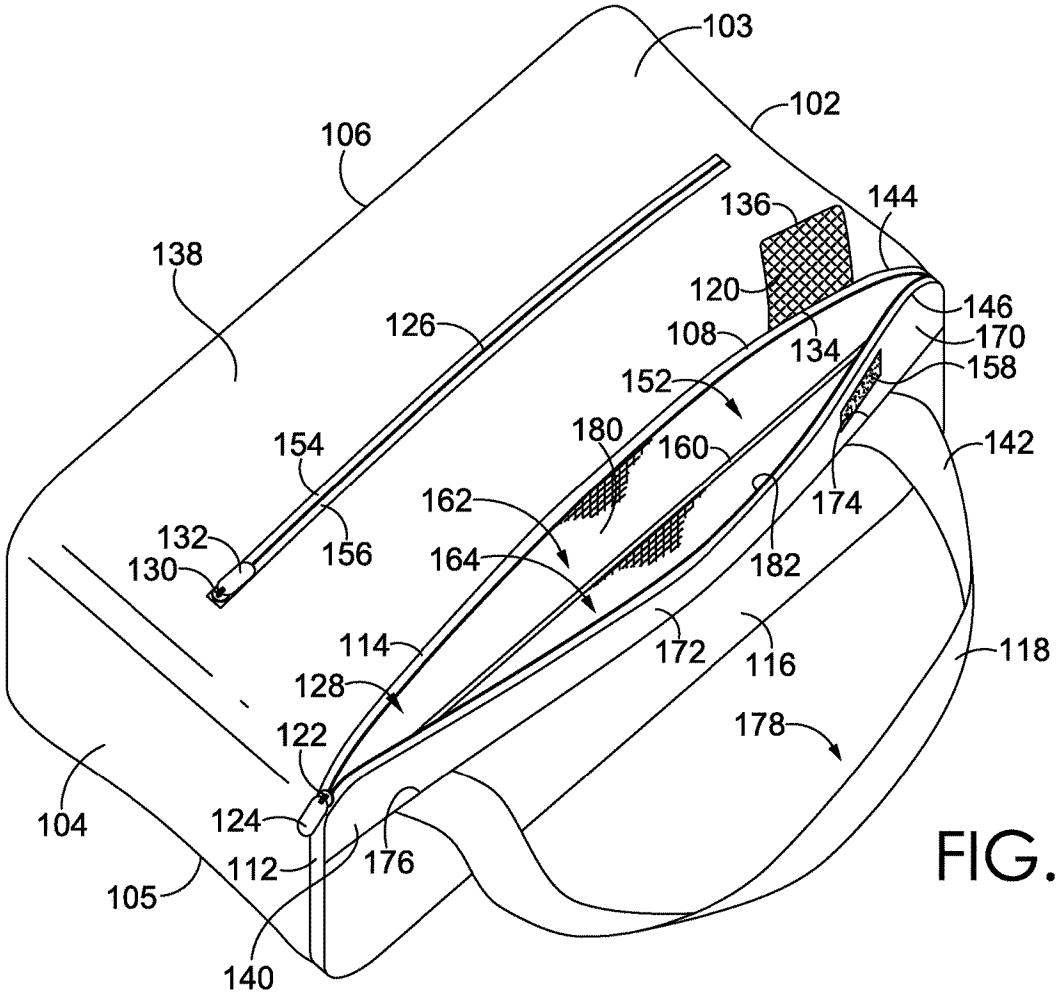
FIG. 3 depicts a top elevation view of the duffel bag of FIG. 1 with a divider positioned in the accessory storage compartment, in accordance with an aspect of the present invention.

In reference to FIG. 3, a top elevation view of the duffel bag 100 of FIG. 1 is shown, with a divider 160 positioned in the accessory storage compartment 140, in accordance with an aspect of the present invention. In FIG. 3, the accessory opening 128 is fully open, the first and second closure mechanisms 120, 122 unsecured. A divider 160 is positioned in the accessory storage space 152, which can be viewed through the opening 128 of the accessory storage compartment 140. The divider 160 shown in FIG. 3 includes a dividing panel dividing at least a portion of the storage space 152 of the accessory storage compartment 140 into a first interior section 162 and a second interior section 164. FIG. 3 also shows an outward-facing surface 180 of the left side 114 of the accessory storage compartment 140 (the outward-facing surface 180 may be coupled, proximate, or contiguous with the right wall 108 of the main compartment 138), and an interior facing surface 182 of the exterior wall 170 facing the outward-facing surface 180. In this aspect, the space between the interior-facing surface 182 and the outward-facing surface 180 defines at least a portion of the accessory storage space 152.

Figure 4:
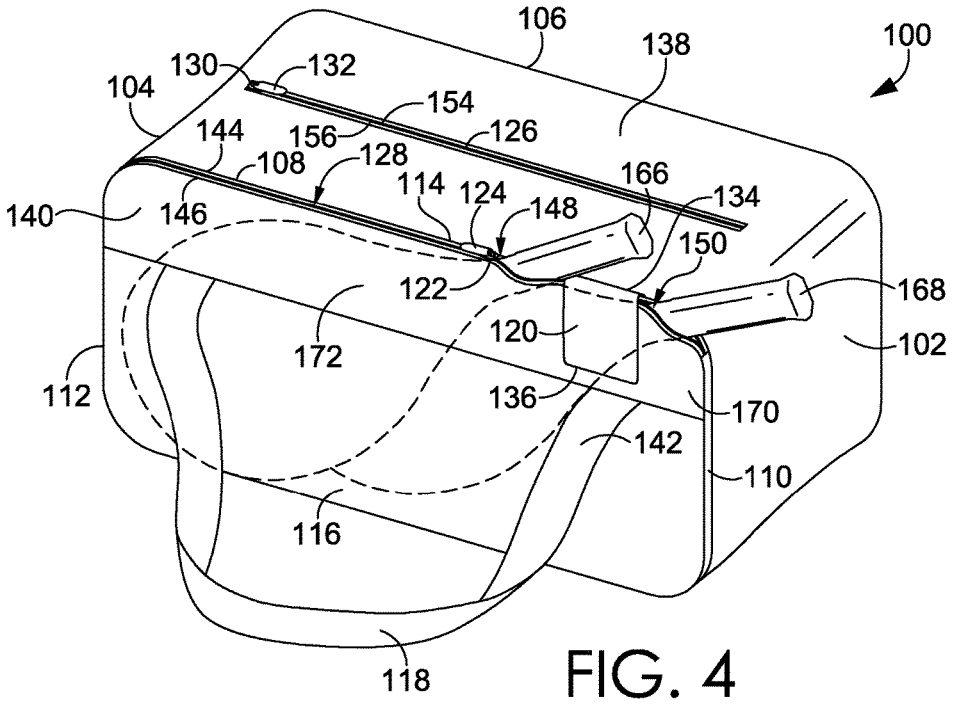
FIG. 4 depicts a side elevation view of the duffel bag of FIG. 1 with equipment stored in the accessory storage compartment, in accordance with an aspect of the present invention.

In reference to FIG. 4, a side elevation view of the duffel bag 100 shown in FIG. 1, with two rackets 166, 168 stored in the accessory storage compartment, is shown, in accordance with an aspect of the present invention. In FIG. 4, the first closure mechanism 120 is releasably attached to the duffel bag 100 with the second end 136 releasably secured to the outward-facing surface 172 of the exterior wall 170 and dividing the opening 128 of the accessory storage compartment 140 into the first and second slots 148, 150. FIG. 4 depicts the accessory storage compartment 140 being used to store tennis rackets 166, 168, a portion of the each of the rackets 166, 168 extruded or extending through the first and the second slots 148, 150. The rackets 166, 168 are partially secured or reinforced by the first and the second closure mechanisms 120, 122 (and the associated zipper pull 124) forming boundaries around the rackets 166, 168. In an alternate configuration, a portion of the rackets 166, 168 may be extended or extruded through only one of the first and the second slots 148, 150, such as through the second slot 150. In this regard, the rackets 166, 168 may be positioned together in a slot, aligned side-by-side. The rackets 166, 168 are merely exemplary and other types of equipment with elongated portions might also be stowed in the accessory storage compartment with a portion extending through a slot, such as a bat, hockey stick, lacrosse stick, and the like.

Although some of these elements are depicted in the figures as sides, walls, ends, faces, and the like, for illustrative purposes, and although they might be referred to as separate elements, the bag may be formed in such a manner that there are not clear delineations between these elements. For example, a single sheet of material may be used to form one or more of the walls, sides, top, bottom, etc. For joining the ends of a single piece of material or joining separate pieces of material together, any suitable joining method may be used including, without limitation, stitching, heat welding, ultrasonic welding, plasma welding, gluing, and the like. A combination of these methods may be used as well. In addition, some of the elements may be identified based on a relative orientation to one another and to the viewer or the carrier of the duffel bag. These respective and relative labels are provided for explanatory purposes and should not be interpreted as limiting the construction or features of the duffel bag, or otherwise limiting the scope of the claimed subject matter.

Moreover, if there are not distinct sides or walls to the bag (e.g., if two or more sides are continuous, in that they are not clearly delineated by the construction of the bag) the sides are distinguished by respective orientation. For example, the "front" facing side does not sit on the ground when the bag is properly placed on the ground. Rather, the bottom or base generally sits on the ground and the front faces towards the viewer. Ambiguous areas between the sides may be referred to as shoulders, joints, or junctions.

Further, the exemplary duffel bag 100 is illustrated to include a three-dimensional shape having substantially rectangular sides, a top, a bottom, and a substantially square front and back wall. Each of the walls or ends may include curves, contours, or other distinguishing shapes that generally outline the square, rectangular, or trapezoidal aspects of the sides, ends, and/or walls of the duffel bag. The duffel bag may include various other three-dimensional shapes and tubular structures, such as a cylinder, square tube, rectangle tube, box shape, cuboid shape, trapezoid shape, and/or other prism shape. Other three-dimensional shapes or structures of the duffel bag and its compartments are contemplated to be within the scope of this disclosure, and some further aspects are described herein with regard to the Figures.

The duffel bag may be made from a single piece of material, or from two or more pieces of like or different materials joined directly or indirectly to one another. Exemplary materials used to form the duffel bag include, without limitation, polyester, nylon, cotton, elastane, leather, suede, faux-leather, faux-suede, hemp, bamboo, polyvinyl chloride, polyurethane, and combinations thereof, including layers or laminates of the same or different materials. The material(s) may be in the form of film, cloth, netting, and/or combinations of such materials. The material or selected materials used in the duffel bag may be water-resistant or water-repellant, inherently or by treatment of the material for hydrophobicity. Water-resistance may be particularly helpful near an exterior-pocket (e.g., to reduce or prevent water transmission from condensation on a bottle of water or other cold beverage) or on the bottom and/or second side of the bag (e.g., to reduce or prevent water transmission if the bag is set down on a wet surface, as for, example, outdoors or near a shower, sink, or pool). The material or selected materials used in the bag may be air and/or water permeable (e.g., to allow the transmission of humid air out of the bag, or fresh and/or drier air into the bag), and may be air and/or water permeable unidirectionally, or both in and out of the bag.

Having described the various figures, other exemplary aspects will now be described. When describing these other aspects, reference may be made to the figures for exemplary purposes. In a first aspect, a duffel bag with a main compartment having a set of walls enclosing a main storage space is provided. The duffel bag may include an accessory storage compartment coupled to an outside surface of at least one wall of the set of walls, the accessory storage compartment including one or more walls that define an accessory storage space between the outside surface and the one or more walls of the accessory storage compartment. The accessory storage compartment may include an opening that provides access to the accessory storage space, and the duffel bag may further include an accessory storage compartment first closure mechanism that divides the accessory storage compartment opening into a first slot and a second slot by releasably bridging the opening. At least one carrying handle or strap may be coupled to the duffel bag.

The main compartment may include a top and a bottom, a front and a back, and a left wall and a right wall. The main compartment may include an opening near the top end that provides access to a main storage space. A closure mechanism may be coupled near the top end of the main compartment for releasably securing the main opening. The closure mechanism may include a releasable fastener, such as a zipper with a zipper pull, which may be used to secure a first edge of the main compartment opening to a second edge of the main compartment opening. The main compartment opening may include a circular, square, or half-moon type shaped opening for providing variable amounts of access into the main storage space.

The accessory storage compartment may be oriented toward a side of the duffel bag and include a set of walls. The walls may define a front and a back, a top and a bottom, and left side and a right side of the accessory storage compartment. The top, bottom, front, and back may be oriented similarly to the main compartment so that the front ends are aligned toward the same end of the duffel bag, the bottoms are aligned toward the same part of the duffel bag, etc. In addition, the main compartment opening and the accessory storage compartment opening may both be on the top end of the duffel bag and adjacent each other, so that both are accessible from the same area of the duffel bag. The main compartment and accessory storage compartment may be positioned so that the left wall of the accessory storage compartment and the right wall of the main compartment are coupled, proximate, aligned, or contiguous with each other. In this regard, the accessory storage compartment may be formed from at least one exterior wall attached to a wall of the main compartment, such that an accessory storage space is at least partially defined by a space between the wall of the main compartment and the exterior wall.

The accessory storage compartment may form any number of shapes, including short or long pocket(s), a square-shaped pocket, an ovular or tube-shaped pocket, or a divided compartment extending around any amount of the outer walls of the main compartment. The accessory storage compartment closure mechanism may include an elongated member having a proximal portion fixedly attached to the duffel bag at a first location and a distal portion that is releasably attachable to the duffel bag at a second location. The distal portion may include a releasable fastener, and the outer surface of the duffel bag may include a mating component for securement of the distal portion. The elongated member may be secured to the duffel bag to releasably fasten first and second edges of the opening of the accessory storage compartment together. The first closure mechanism may include releasable fasteners of various types, such as velcro, hook-and-loop fasteners, male/female clips, buckles, snaps, buttons, clips with spring loaded gates, magnets, ring-and-stud fasteners, and the like. As shown in FIG. 2B, the first closure mechanism 120 may include a first end 134 and a second end 136, the second end 136 being the releasable, distal portion. The first end 134 is affixed to the duffel bag 100 near the top end 103 of the main compartment 138. The second end is releasably secured to the outward facing side 172 of the exterior wall 170 of the accessory compartment 140.

The accessory storage compartment may further include a second releasable closure mechanism positioned near the accessory storage compartment opening. The second releasable closure mechanism may include any of the closure mechanisms described herein, including zippers, snaps, velcro, and the like. For example, the second releasable closure mechanism may include a releasable fastener, such as a zipper with a zipper pull, that releasably engages and secures first and second edges of the accessory opening together along a length of the opening. The first and second closure mechanisms may be independent, such that they can be engaged, or rather, releasably secured, separately or simultaneously. As shown in FIGS. 2C and 2D, the first closure mechanism may be secured to divide the accessory storage opening into a first slot and a second slot, and the second closure mechanism, which in FIGS. 2C and 2D is a zipper mechanism 122 with a zipper pull 124, may be engaged to releasably secure the edges of the accessory opening. The second closure mechanism may be moved such that it is proximate, or aligned with, the first closure mechanism, as shown in FIG. 2D. Thus, when the carrying handle is in the carrying configuration, the handle may cover at least part of the first and second closure mechanisms to provide added securement for the accessory storage space.

The first closure mechanism may be aligned towards an end of the bag, or rather, an end of the accessory storage compartment opening, so that when the first closure mechanism is engaged, it provides a first slot and a second slot of different lengths (i.e., one slot is longer than the other). The accessory storage compartment may further include additional closure mechanisms, which may be the same or different as the first and the second closure mechanisms. For example, the accessory storage compartment may include a third closure mechanism similar to the first closure mechanism, the third closure mechanism located on a different portion of the accessory opening, such as toward an opposite end as compared to the first closure mechanism. Any number, combination, or variation of closure mechanisms may be used to provide multiple methods of possible securement for the opening, and that allow division or partitioning of the opening into different slots for storage alignment purposes.

The accessory storage space may include a divider. The divider may include on or more dividing panels extending across at least a portion of the accessory storage compartment. For example, a dividing panel may extend from the front end to the back end of the accessory storage compartment, dividing at least a portion of the accessory storage space into a first interior section and a second interior section. When the first closure mechanism is secured, the first slot and the first interior section may be alignable to form a first equipment-storage compartment, and the second slot and the second interior section may be alignable to form a second equipment-storage compartment. The accessory storage space may include one or more padded elements to provide protection for objects or equipment stored in the equipment-storage compartments. For example, the divider and/or walls of the accessory storage space may be padded to protect the head of a tennis racket or other objects.

The dividing panel may be connected to ends of the storage space or the bottom of the storage space, and may be coupled to a wall of the accessory storage compartment. The dividing panel may be coupled to an inside wall of the accessory storage space that is proximate a wall of the main storage compartment, a first end of the dividing panel coupled to the wall at a first location, directly, or via a first side panel, and a second end of the dividing panel coupled to the wall at a second location, directly, or via a second side panel. The dividing panel may be removable or interchangeable, and may contain a padded element. The space between an inward facing surface of the dividing panel, which faces towards the main compartment, and a wall of the accessory storage space may define at least a portion of the first interior section. The space between an outward facing surface of the dividing panel, which may face away from the main storage compartment, and the exterior wall of the accessory storage compartment may define at least a portion of the second interior section of the accessory storage compartment. An example of this is shown in FIG. 3, which depicts a divider 160 dividing the accessory storage compartment into a first interior section 162 and a second interior section 164.

The duffel bag may include one or more carrying handles for carrying and securement of the duffel bag. In this regard, in the carrying configuration, the handle may be oriented upward such that at least a portion of the handle is coupled to at least a portion of the first closure mechanism (i.e., lockdown strap), so that the handle at least partially overlays the first closure mechanism, forming a stacked arrangement. In this aspect, the handle may cover at least 50% of the first closure mechanism. The second closure mechanism may also be secured so that the handle, first closure mechanisms, and second closure mechanism are stacked together in an overlaying configuration. For example, in FIG. 2F, the first closure mechanism 120 is secured and the second closure mechanism 122 is engaged so that the zipper pull 124 is proximate or coupled to the first closure mechanism 120, and the handle 118 of the duffel bag 100 is position with a portion 142 of the handle 118 overlaying the first and second closure mechanisms 120, 122, to provide the stacked arrangement described herein. In another aspect, a third closure mechanism similar to the first closure mechanism may be positioned near an opposite end of the opening to divide the opening into multiple slots or compartments when the first and third closure mechanisms are engaged. The third closure mechanism may be positioned so that a separate portion of the handle aligns with and overlays the third closure mechanism.

In a second aspect, a duffel bag with a main compartment having a set of walls enclosing a main storage space is provided. The duffel bag includes an accessory storage compartment coupled to an outward-facing surface of a wall of the set of walls, the accessory storage compartment including an exterior wall that at least partially defines an accessory storage space between the exterior wall and the outward-facing surface. The exterior wall includes an interior surface, which faces towards the outward-facing surface and the accessory storage space, and an exterior surface generally opposing the interior surface and facing away from the accessory storage space. The accessory storage compartment also includes an opening that provides access to the accessory storage space. The duffel bag includes a lockdown strap having a proximal end attached to the duffel bag, the lockdown strap having a distal end releasably attachable to the exterior surface of the exterior wall, the lockdown strap dividing the opening into a first slot and a second slot when the distal end is attached to the exterior surface and releasably bridging the opening. The duffel bag further includes a carrying handle attached to the exterior surface at an attachment point and including a detached elongated portion extending from the attachment point, the detached elongated portion configurable into a carrying arrangement in which the detached elongated portion at least partially obscures the distal end of the lockdown strap when the first end is attached to the exterior surface.

The exterior wall may include a top portion, a bottom portion, and a first end and a second end. The attachment point attaches to the exterior surface between the top portion and the bottom portion. The distal end of the lockdown strap may attach to the exterior surface between the attachment point and the top end. Additionally, when the duffel bag is in the carrying arrangement, the detached elongated portion extends from the attachment point between the top portion towards the bottom portion. The duffel bag may further include a first edge and a second edge at least partially defining the accessory storage compartment opening, and a zipper mechanism coupled near the first edge and the second edge and configured to releasably fasten the first edge to the second edge. The detached elongated portion, the distal end of the lockdown strap, and a zipper pull of the zipper mechanism may be positionable in a stacked arrangement when the detached elongated portion is configured in a carrying arrangement, the distal end of the lockdown strap is attached, and the zipper pull is positioned beneath the lockdown strap to releasably fasten a portion of the first edge to a portion of the second edge. In this regard, the zipper mechanism may be configured to close one of the first slot or the second slot when the zipper pull and the lockdown strap are in a stacked arrangement.

In a third aspect, a duffel bag is provided. The duffel bag includes a main compartment having a set of walls that define a main storage space, the main compartment having a top and a bottom, a first side and a second side, and a front side and a back side. The main compartment top end includes a first opening that provides access to the main storage space, and an accessory storage compartment coupled to an outside surface of the main compartment and oriented towards a side of the main compartment, the accessory storage compartment having a set of walls that define an accessory storage space, the accessory storage compartment having a top end and a bottom end, a first side and a second side, and a front side and a back side. The accessory storage compartment may include a second opening that provides access to the accessory storage space, and a closure mechanism coupled near the top end of the accessory storage compartment, the closure mechanism dividing the second opening into a first slot and a second slot by releasably bridging the second opening. The accessory storage space may include a divider positioned in the accessory storage space and extending between the front side and the back side of the accessory storage compartment, the divider separating at least a portion of the accessory storage space into a first interior section and a second interior section, wherein the first slot and the first interior section are alignable to form a first equipment-storage compartment, and the second slot and the second interior section are alignable to form a second equipment-storage compartment. The duffel bag may further include a carrying handle coupled to the duffel. When the carrying handle is configured in a carrying arrangement, the carrying handle may at least partially overlay the second closure mechanism, such that the carrying handle and the closure mechanism are in contact.

Numerous variations of the aspects described herein are possible that provide different arrangements of the components described, or the addition of additional components that add functionality to the duffel bag. For example, the first closure mechanism, or the lockdown strap, may be positioned anywhere on the opening of the accessory storage compartment, and multiple closure mechanisms or lockdown strap mechanisms may be used with the opening of the accessory storage compartment.

A variation of the duffel bag described herein may include a second accessory storage compartment coupled, affixed, or positioned adjacent to or oriented along another side of the main storage compartment. The second accessory storage compartment may include similar features as the first accessory storage compartment, with a second carrying handle coupled to an exterior side of the second accessory storage compartment, providing a similar securement mechanism as the configuration described in relation to the first accessory storage compartment. Additional pockets may be positioned on the exterior of the accessory storage compartment as well, to provide different storage options.

From the foregoing, it will be seen that this invention is one well adapted to attain all the ends and objects herein set forth together with other advantages which are obvious and which are inherent to the structure. It will be understood that certain features and subcombinations are of utility and may be employed without reference to other features and subcombinations. This is contemplated by and is within the scope of the claims. Since many possible embodiments may be made of the invention without departing from the scope of the claims, it is to be understood that all matter herein set forth or shown in the accompanying drawings is to be interpreted as illustrative and non-limiting.

What is claimed is:

1. A duffel bag with a main compartment having a set of walls enclosing a main storage space, the duffel bag comprising:

an accessory storage compartment coupled to an outside surface of at least one wall of the set of walls, the accessory storage compartment comprising one or more walls that define an accessory storage space between the outside surface and the one or more walls of the accessory storage compartment, wherein the accessory storage compartment includes an opening that provides access to the accessory storage space;

a closure mechanism comprising an elongated member that, when releasably secured, divides the opening into a first slot and a second slot by releasably bridging the opening; and a carrying handle coupled to the duffel bag, wherein the carrying handle is configurable in a carrying arrangement, and wherein the carrying handle at least partially overlays the closure mechanism when the carrying handle is configured in the carrying arrangement.

2. The duffel bag of claim 1, wherein the elongated member includes a proximal portion fixedly attached to the duffel bag and a distal portion releasably attachable to the duffel bag, and wherein the closure mechanism divides the opening into the first slot and the second slot when the distal portion is releasably attached.

3. The duffel bag of claim 2, wherein the distal portion includes a releasable fastener.

4. The duffel bag of claim 1, wherein, when the carrying handle is configured in the carrying arrangement, the carrying handle and the closure mechanism form a stacked arrangement with the carrying handle at least partially overlaying the closure mechanism.

5. The duffel bag of claim 4, wherein, when the carrying handle is configured in the carrying arrangement, the carrying handle overlays and contacts at least fifty percent of the closure mechanism.

6. The duffel bag of claim 1, further comprising:

a first edge and a second edge that at least partially define the opening; and a releasable closure mechanism coupled near the first edge and the second edge that is configured to releasably fasten the first edge to the second edge.

7. The duffel bag of claim 6, wherein the releasable closure mechanism includes a zipper mechanism having a zipper pull.

8. The duffel bag of claim 7, wherein the closure mechanism, the carrying handle, and the zipper pull are positionable in a stacked, overlaying arrangement when the carrying handle is configured in the carrying arrangement.

9. The duffel bag of claim 1, further comprising a divider positioned in the accessory storage space and extending between the outside surface and the one or more walls of the accessory storage compartment, the divider separating at least a portion of the accessory storage compartment into a first interior section and a second interior section, wherein the first slot and the first interior section are alignable to form a first equipment-storage compartment, and the second slot and the second interior section are alignable to form a second equipment-storage compartment.

10. The duffel bag of claim 1, wherein the set of walls includes a top wall having a main compartment opening and a bottom wall opposite the top wall and forming a base of the duffel bag, and wherein, in the carrying arrangement, the carrying handle extends from an attachment point, at which the carrying handle is coupled to the duffel bag, towards the top wall, the carrying handle configured to support a load applied to the bottom wall in the carrying arrangement.

11. The duffel bag of claim 1, wherein the opening includes a first end and a second end, and wherein the closure mechanism is oriented closer to the first end, such that one of the first and the second slots is longer than the other.

12. A duffel bag with a main compartment having a set of walls enclosing a main storage space, the duffel bag comprising:

an accessory storage compartment coupled to an outward-facing surface of a wall of the set of walls, the accessory storage compartment comprising an exterior wall that at least partially defines an accessory storage space between the exterior wall and the outward-facing surface, wherein the exterior wall includes a top portion, a bottom portion, an interior surface, which faces towards the outward-facing surface and the accessory storage space, and an exterior surface generally opposing the interior surface and facing away from the accessory storage space, and wherein the accessory storage compartment includes an opening that provides access to the accessory storage space;

a lockdown strap having a proximal end attached to the duffel bag and having a distal end releasably attachable to the exterior surface of the exterior wall, the lockdown strap dividing the opening into a first slot and a second slot when the distal end is attached to the exterior surface and is releasably bridging the opening; and a carrying handle attached to the exterior surface at an attachment point and including a detached elongated portion extending from the attachment point, wherein the detached elongated portion is configurable into a carrying arrangement in which the detached elongated portion extends at least partially towards the top portion of the exterior wall to at least partially overlay the distal end of the lockdown strap when the distal end is attached to the exterior surface.

13. The duffel bag of claim 12, wherein the attachment point is located on the exterior surface between the top portion and the bottom portion.

14. The duffel bag of claim 13, wherein the distal end of the lockdown strap attaches to the exterior surface between the attachment point and the top portion.

15. The duffel bag of claim 13, wherein the set of walls includes a top wall having a main compartment opening and a bottom wall opposite the top wall and forming a base of the duffel bag, and wherein, in the carrying arrangement, the carrying handle extends from the attachment point towards the top wall, the carrying handle configured to support a load applied to the bottom wall in the carrying arrangement.

16. The duffel bag of claim 12, further comprising:

a first edge and a second edge that at least partially define the opening; and a zipper mechanism coupled near the first edge and the second edge and configured to releasably fasten the first edge to the second edge.

17. The duffel bag of claim 16, wherein the detached elongated portion, the distal end of the lockdown strap, and a zipper pull of the zipper mechanism are positionable in a stacked arrangement when the detached elongated portion is configured in the carrying arrangement, the distal end of the lockdown strap is attached, and the zipper pull is moved beneath the lockdown strap to releasably fasten a portion of the first edge to a portion of the second edge.

18. The duffel bag of claim 17, wherein the zipper mechanism closes one of the first slot or the second slot when the zipper pull and the lockdown strap are in the stacked arrangement.

19. A duffel bag comprising:

a main compartment having a set of walls that define a main storage space, the main compartment having a top and a bottom, a first side and a second side, and a front side and a back side, wherein the main compartment top end includes a first opening that provides access to the main storage space;

an accessory storage compartment coupled to an outside surface of the main compartment and oriented towards a side of the main compartment, the accessory storage compartment having a set of walls that define an accessory storage space, the accessory storage compartment having a top end and a bottom end, a first side and a second side, and a front side and a back side, wherein the accessory storage compartment includes a second opening that provides access to the accessory storage space;

a closure mechanism comprising an elongated member coupled near the top end of the accessory storage compartment, wherein the closure mechanism, when releasably secured, divides the second opening into a first slot and a second slot by releasably bridging the second opening;

a divider positioned in the accessory storage space and extending between the front side and the back side of the accessory storage compartment, the divider separating at least a portion of the accessory storage space into a first interior section and a second interior section, wherein the first slot and the first interior section are alignable to form a first equipment-storage compartment, and the second slot and the second interior section are alignable to form a second equipment-storage compartment; and a carrying handle coupled to the duffel bag, wherein the carrying handle is configurable in a carrying arrangement, and wherein the carrying handle at least partially overlays the closure mechanism when the carrying handle is configured in the carrying arrangement.

20. The duffel bag of claim 19, wherein, when the carrying handle is configured in the carrying arrangement, the carrying handle and the closure mechanism are in contact forming a stacked arrangement with the carrying handle covering at least a portion of the elongated member.

* * * * *